US011719010B1

(12) United States Patent
VonQualen et al.

(10) Patent No.: US 11,719,010 B1
(45) **Date of Patent: *Aug. 8, 2023**

(54) DEMOLITION TOOL

(71) Applicants: Gerald VonQualen, Gardner, IL (US); Gary Cox, Gardner, IL (US)

(72) Inventors: Gerald VonQualen, Gardner, IL (US); Gary Cox, Gardner, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/670,628

(22) Filed: Feb. 14, 2022

Related U.S. Application Data

(63) Continuation of application No. 16/952,870, filed on Nov. 19, 2020, now Pat. No. 11,248,384.

(51) Int. Cl.
*E04G 23/08* (2006.01)

(52) U.S. Cl.
CPC ..... *E04G 23/08* (2013.01); *E04G 2023/085* (2013.01)

(58) Field of Classification Search
CPC .... E04G 2023/085; E04G 23/08; B66F 15/00
See application file for complete search history.

(56) References Cited

U.S. PATENT DOCUMENTS 11,248,384 B1 * 2/2022 VonQualen ..... E04G 23/08

* cited by examiner

*Primary Examiner* — Janine M Kreck
(74) *Attorney, Agent, or Firm* — Charles T. Riggs, Jr.

(57) ABSTRACT

A demolition tool comprises first and second elongated bar portions, and first and second fork portions integrally formed at an angle to the first and second elongated bar portions respectively. The first and second elongated bar portions are generally parallel to each other, spaced apart at a predetermined distance, and connected together via plates and/or cross bars. In use, the demolition tool is grasped by the user with two hands at its handle end portions.

20 Claims, 10 Drawing Sheets

DEMOLITION TOOL

There exist a variety of demolition tools used by many workers, primarily in the construction industry. However, many of these tools are complicated, cumbersome or difficult and/or time consuming to use.

A basic, well know demolition tool is a crowbar. A crowbar is an iron or steel bar that is usually wedge-shaped at the working end for use as a pry or lever. At the opposite 15 end, the user grasps the bar typically with two hands together or in close proximity at the end of the bar, and exerts a force on the end of the bar. A crowbar can be difficult to use in that it may be hard to properly position at a location where prying is needed, and there may not be a suitable surface to pry against. It may also be difficult to exert the proper amount to prying force to a crow bar to achieve the proper prying result. A crowbar often needs to be repositioned frequently, and several prying attempts made before achieving success. This process not only can be time consuming, but also can cause use fatigue or injury.

Accordingly, to address and overcome the inefficiencies, limitations and disadvantages of existing demolition tools, an improved demotion tool is needed. The device and method of use disclosed herein fulfill such needs. It is desired that the presently disclosed product and method be applicable generally to any instances or applications involving the use of a tool for prying and/or demolition.

SUMMARY

The present disclosure relates to a demolition tool for use in prying applications and/or demolition jobs. The demolition tool has two generally parallel elongated bar sections and two shorter bars or fork sections disposed at an angle to the elongated bar sections, respectively. The two elongated bar sections are connected to each other via two connectors, preferably in the form of plates. An additional connector, preferably in the form of a cross bar, is located at the angled portion between the elongated bar sections and the shorter bar sections. In certain applications, the cross bar may serve as a prying surface. The shorter bar sections are used as the prying end for the demolition tool. The elongated bar sections are used at their free end as handles for the user. Accordingly, the demolition bar has two handle portions allowing the user to grasp the two handle portions, one handle portion in each of the user's hands, which facilitates and increases the applied pressure to the work being done.

The demolition tool disclosed herein allows for the easy removal of building surfaces such as drywall, lathe and plaster, plywood, furring strips, sub floors, construction lumber, paneling and the like. The demolition tool is small and powerful, and saves time and money by allowing more work to be completed in a given time when compared to conventional tools.

BRIEF DESCRIPTION OF DRAWINGS

The drawing figures depict one or more implementations in accord with the present teachings, by way of example only, not by way of limitation. In the drawing figures, like reference numerals refer to the same or similar elements.

DETAILED DESCRIPTION

Figure 1:
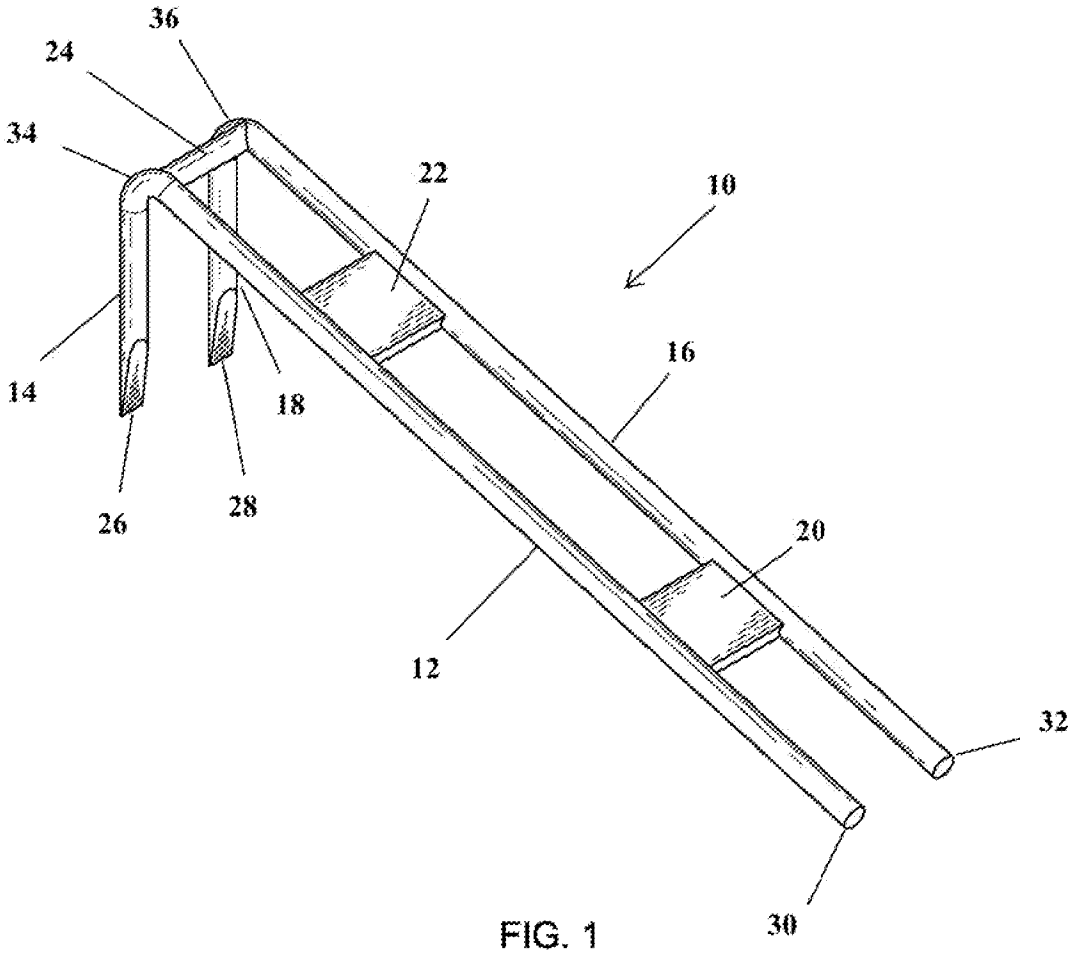
FIG. 1 is a perspective view of the demolition tool of the present disclosure.

The product(s) and method(s) of the present disclosure provide numerous advantages, novel features and/or improvements in providing and using a demolition tool, including but not limited to providing two handle portions for two handed use. Discussed below and shown in the drawings are some of these advantages, novel features and/or improvements. Additional advantages, novel features and/or improvements will become apparent to those skilled in the art upon examination of the disclosure herein and the accompanying drawings, or may be learned by production or operation of the examples.

FIGS. 1-7 show various views of the demotion tool of the present disclosure. In FIG. 1, a perspective view of the demotion tool is show. As can be seen, the demolition tool 10 comprises a first elongated bar portion 12, and a first fork portion 14 integrally formed with and at an angle to the first elongated bar portion 12. The demolition tool 10 further comprises a second elongated bar portion 16, and a second fork portion 18 integrally formed with and at an angle to the second elongated bar portion 16. First elongated bar portion and first fork portion 14 are connected at a curved portion or transition section 34. Second elongated bar portion 16 and a second fork portion 18 are connected at a curved portion or transition section 36.

The first elongated bar portion 12 has a free end or handle portion end 30, and the second elongated bar portion 16 has a free end or handle portion end 32. This allows the demolition tool 10 to be grasped by the user with two hands at or near the handle end portions 30 and 32 respectively.

The first fork portion 14 preferably has a first tapered or beveled end 26, and the second fork portion 18 preferably has a second tapered or beveled end 28, for assisting with prying between two objects in close proximity. Alternatively, and/or additionally, tapered or beveled ends may be provided at the ends 30 and 32 of the first elongated bar portion 12 and the second elongated bar portion 16, respectively.

First elongated bar portion 12 and first fork portion 14 together lie in a first plane, while second elongated bar portion 16 and a second fork portion 18 together lie in a second plane. The first plane is substantially parallel to the second plane, such that the first elongated bar portion 12 is substantially parallel to the second elongated bar portion 16, and the first fork portion 14 is substantially parallel to the second fork portion 18.

The first elongated bar portion 12 and the second elongated bar portion 16 are spaced apart at a predetermined distance, and are connected together via at least two connector portions. As illustrated, the first elongated bar portion 12 and the second elongated bar portion 16 are connected together via a first connector portion 20, a second connector portion 22 and a third connector portion 24. The first connector portion 20 and the second connector portion 22 preferably take the form of a plate. The third connector portion 24 preferably takes the form of a cross bar. The two plates 20 and 22 are preferably located along the lengths of the first elongated bar portion 12 and the second elongated bar portion 16 and are suitably affixed thereto, such as by welding. The cross bar 24 is preferably located at the curved transition sections 34 and 36 and is suitably affixed thereto, such as by welding.

Figure 2:
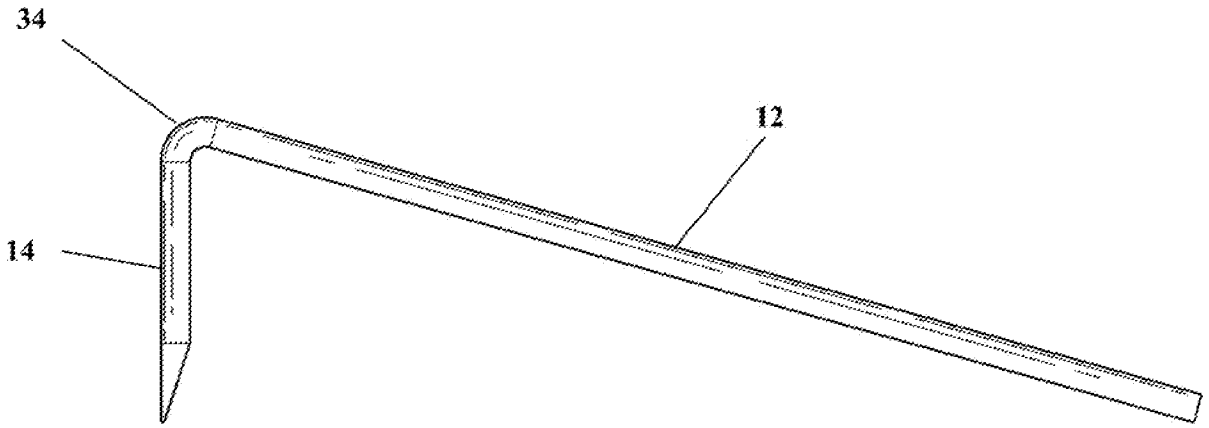
FIG. 2 is a side view of the demolition tool of the present disclosure.

FIG. 2 is a side view of the demolition tool 10 of the present disclosure. A first side is depicted wherein first elongated bar portion 12, first fork portion 14 and first curved transition portion 34 can be seen. The first elongated bar portion 12, first fork portion 14 and first curved transition portion 34 are all one integral bar.

Figure 3:
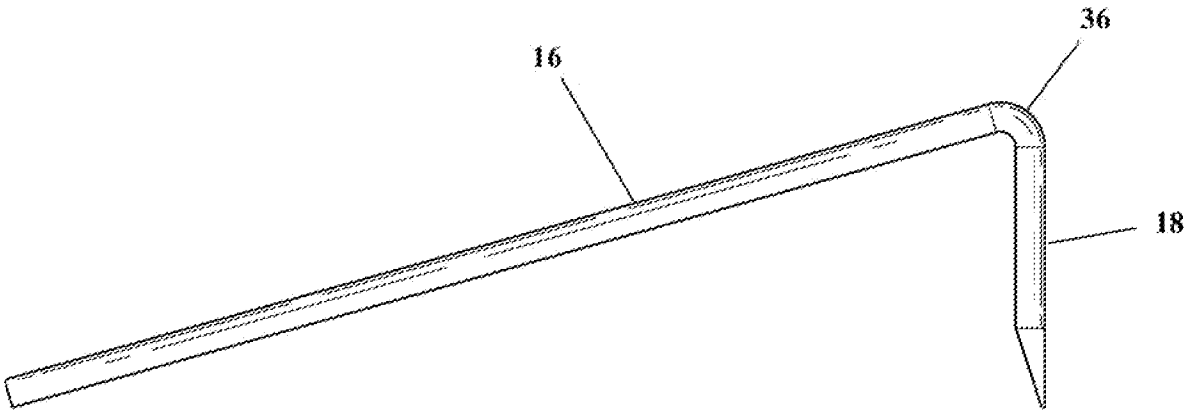
FIG. 3 is an opposite side view of the demolition tool of the present disclosure.

FIG. 3 is an opposite side view of the demolition tool 10 of the present disclosure. A second side is depicted wherein second elongated bar portion 16, second fork portion 18 and second curved transition portion 36 can be seen. The second elongated bar portion 16, second fork portion 18 and second curved transition portion 36 are all one integral bar.

Figure 4:
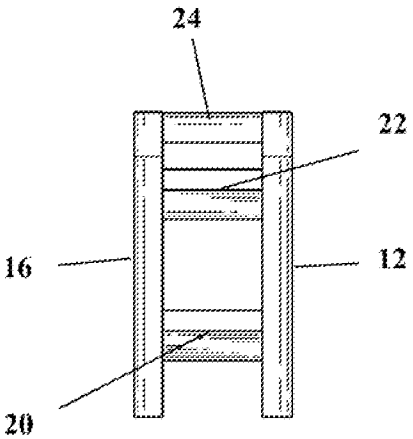
FIG. 4 is an end view of the demolition tool of the present disclosure.

FIG. 4 is an end view of the demolition tool 10 of the present disclosure, as seen from the fork portion end of the demolition tool 10. Connecting portions 20, 22 and 24 are shown connecting first elongated bar portion 12 with second elongated bar portion 16.

Figure 5:
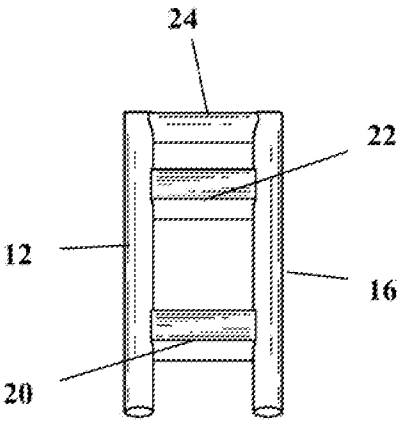
FIG. 5 is an opposite end view of the demolition tool of the present disclosure.

FIG. 5 is an opposite end view of the demolition tool 10 of the present disclosure, as seen from the handle portion end of the demolition tool 10. Connecting portions 20, 22 and 24 are shown connecting first elongated bar portion 12 with second elongated bar portion 16.

Figure 6:
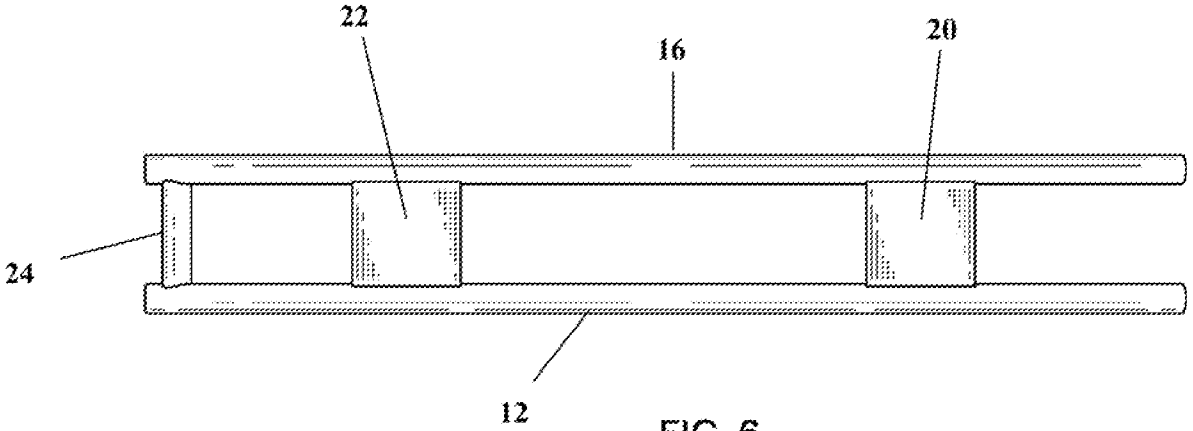
FIG. 6 is a top view of the demolition tool of the present disclosure.

FIG. 6 is a top view of the demolition tool 10 of the present disclosure. Connecting portions 20, 22 and 24 are shown connecting first elongated bar portion 12 with second elongated bar portion 16.

Figure 7:
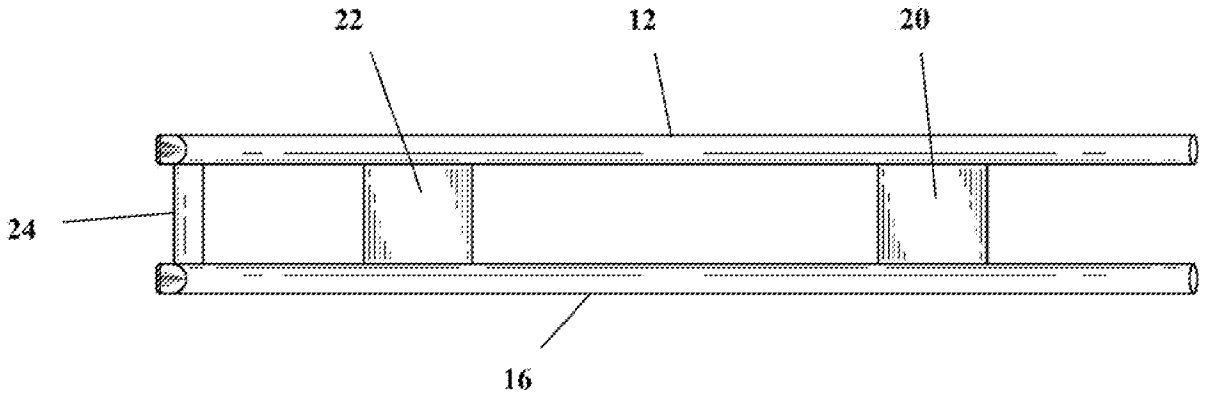
FIG. 7 is a bottom view of the demolition tool of the present disclosure.

FIG. 7 is a bottom view of the demolition tool 10 of the present disclosure. Connecting portions 20, 22 and 24 are shown connecting first elongated bar portion 12 with second elongated bar portion 16.

Figure 8:
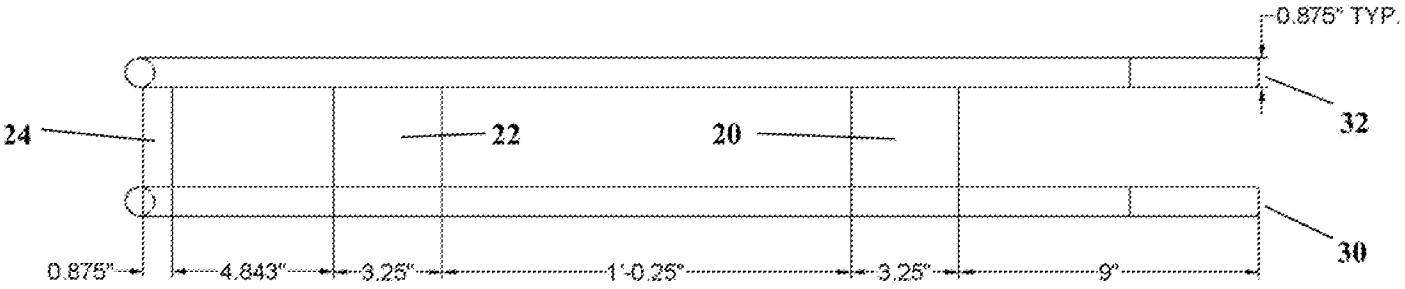
FIG. 8 is a top view of the demolition tool with dimensions illustrated.
Figure 10:
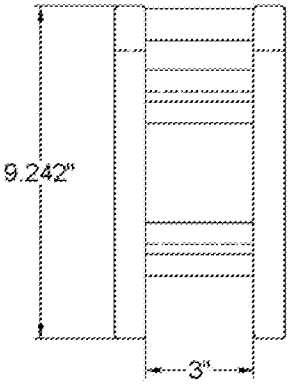
FIG. 10 is an end view of the demolition tool with dimensions illustrated.
Figure 9:
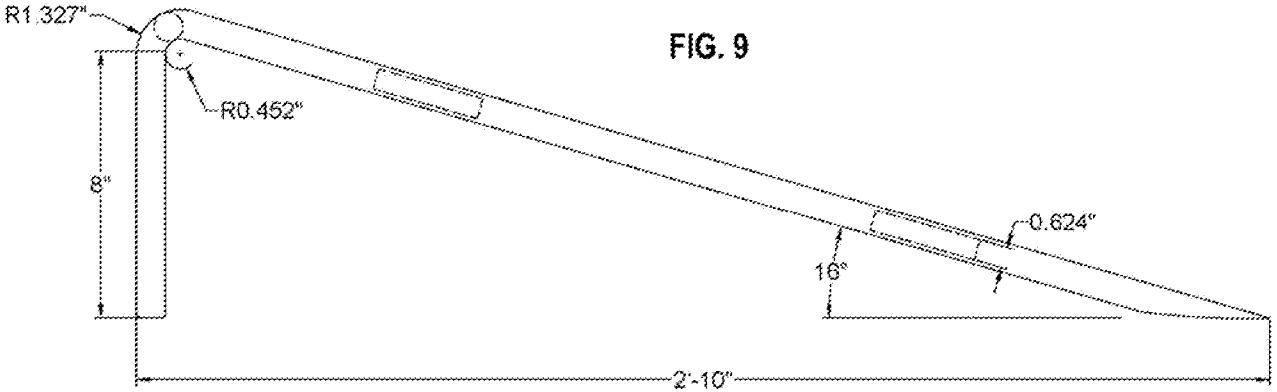
FIG. 9 is side view of the demolition tool with dimensions illustrated.

FIGS. 8-10 illustrate views of the demolition tool 10 with preferred dimensions. In this embodiment of FIGS. 8-10, the elongated bar ends 30 and 32 are illustrated as being tapered or beveled, while the fork ends are not.

FIG. 8 is a top view of the demolition tool 10 with preferred dimensions illustrated as follows. The cross bar has a diameter of 0.875 inches. The linear distance (straight line distance as viewed from the top of the demolition tool. i.e., the "a" distance in the formula $a^2+b^2=c^2$ where "c" is the actual length measurement of the part and "b" is the vertical rise of the part) between the cross bar 24 and the second plate 22 is 4.843 inches. The linear length of the second plate 22 is 3.25 inches. The linear distance between the second plate 22 and first plate 20 is 1 ft. 0.25 inches (12.25 inches). The linear length of the first plate 20 is 3.25 inches. The linear length of the handle end portion from first plate 20 to handle ends 30, 32 is 9 inches. The elongated bar portions, the curved transition portions and the fork portions all have a diameter of 0.875 inches.

FIG. 9 is side view of the demolition tool 10 with preferred dimensions illustrated as follows. The total linear length of the demolition tool is 2 ft. 10 inches (34 inches) (medium size tool). However, a preferred range for the length of the demolition tool is 1 ft. 10 in. (small size tool) to 4 ft. 6 in. (large size tool). The height of each fork portion is 8 inches. This height may be prorated according to the length of the tool. For example, a 1 ft. 10 in. tool may have a 6 inch fork, while a 4 ft. 6 in. tool may have 12 inch forks. In general, it is preferred that at least 8 inch forks are used for tool lengths of 33 inches or longer. The inner radius of each curved transition portion is 0.452 inches. The outer radius of each curved transition portion is 1.327 inches. The angle of the elongated bar portions as measured from the horizon is 16 degrees. Each plate has a thickness of 0.624 inches.

FIG. 10 is an end view of the demolition tool 10 with preferred dimensions illustrated as follows. The height from the ends of the demotion tool to the top of the cross bar is 9.242 inches. The width of the plates, and thus the distance between the elongated bar portions, is 3 inches. This width can also be prorated and made wider when the tool is of a longer length, or less wide when the tool is of a lesser length. Further, one or more additional plates made be used when the tool is of a longer length.

It should be understood that the foregoing dimensions are all preferred dimensions, and that these dimensions can vary or be prorated without departing from the spirit and scope of the present disclosure. However, the ratio of the height of the fork portions and the overall linear length are preferably in the range of 1:6 and 5:16, and preferably 4:17 for the medium size tool, 3:11 for the small size tool and 5:27 for the large size tool. Further, the width of the plates should preferably be in the range of 2 inches to 6 inches, and preferably 3-4 inches.

Figure 11:
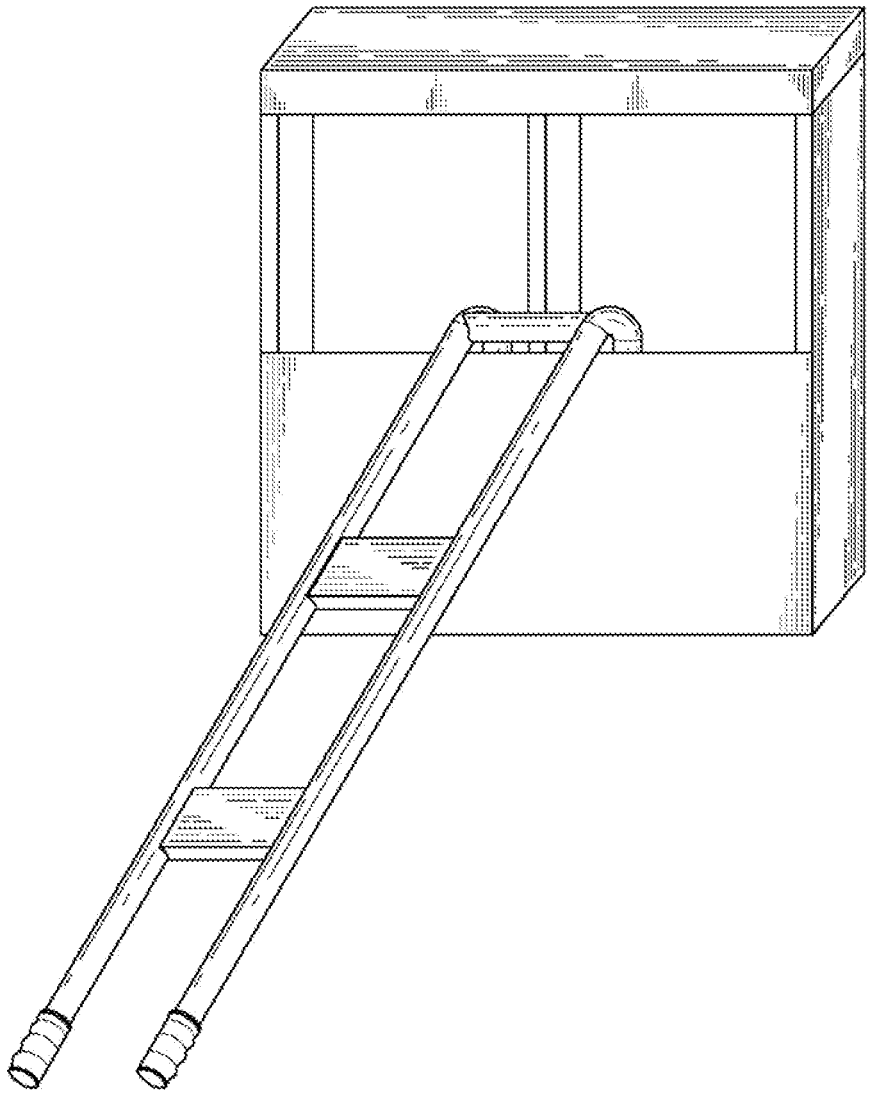
FIG. 11 is a perspective view illustrating the demolition tool in use.
Figure 12:
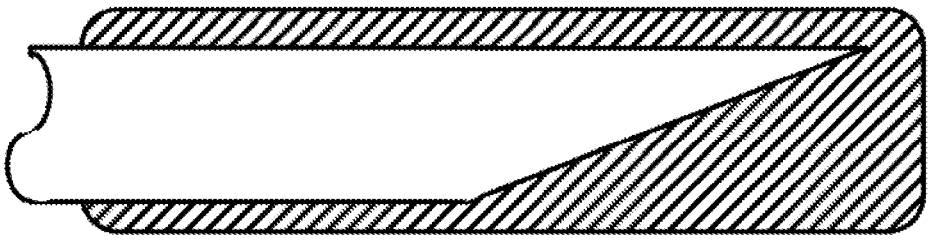
FIG. 12 is a cross section view of a handle end of the tool having a hand grip thereon.

FIG. 11 is a perspective view illustrating the demolition tool in use. A wall or wall section made from 2×4 studs is illustrated generally with a sheet or section of drywall attached to the lower half thereof. The demolition tool 10 is positioned with one fork portion on each side of the center 2×4, and extending downward behind the drywall. Once positioned as such, the user simply need lift or push up on the handle end portions of the demotion tool 10 to separate the drywall from at least the center 2×4 in the location of the fork portions, however the entire section of drywall could be separated depending on how well it is attached. As the demotion tool 10 is lifted, the cross bar 24 will act as a fulcrum for the demolition tool 10. In the embodiment illustrated in FIG. 11, the handle end portions of the demotion tool are provided with hand grips 38 and 40 which wrap around or slide onto the handle ends 30 and 32 respectively. If the handle ends are tapered or beveled, is the grips can be formed to conform to the shape of the tapered or beveled end of the elongated bar portions, as shown in the cross section view of FIG. 12.

Figure 13:
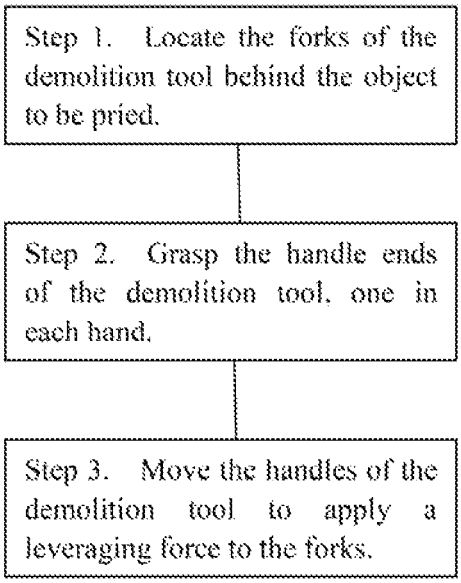
FIG. 13 is a flow chart of a method of use of the demolition tool.

FIG. 13 is a flow chart of a basic method of use of the demolition tool 10. In step 1, the fork portions of the demolition tool 10 are positioned behind the object to be pried. In step 2, the handle end portions of the demolition tool 10 are grasped by the user, one in each hand. In step 3, the handle end portions of the demolition tool are lifted or moved by either pushing or pulling on the handle end portions of the demolition tool to apply a leveraging force to the fork portions.

It should be understood that the components of the device disclosed herein can take any suitable form, including any suitable materials or components capable of adequately performing their respective intended functions, as may be known in the art. For example, demolition tool 10 may be iron or steel. Additionally, the demolition tool 10 may be made of a high-strength aluminum alloy, for example as may be used in bicycle frames. Also, the demolition tool 10 may be made of reinforced fiberglass with metal. Further, while the embodiments) are illustrative of the structure, function and operation of the exemplary device(s) and method(s), it should be understood that various modifications may be made thereto with departing from the teachings herein.

While the foregoing discussion presents the teachings in an exemplary fashion with respect to a demolition tool and method of using the same, it will be apparent to those skilled in the art that the present disclosure may apply to any type of device, product or method where items are to be pried apart or separated. Further, while the foregoing has described what are considered to be the best mode and/or other examples, it is understood that various is modifications may be made therein and that the subject matter disclosed herein may be implemented in various forms and examples, and that the product(s) and method(s) may be applied in numerous applications, only some of which have been described herein.

What is claimed is:

1. A demolition tool comprising:

a first elongated bar portion having a first fork end portion and a first handle end portion;

a first fork portion formed at an acute angle to the first elongated bar portion at the first fork end portion;

a second elongated bar portion having a second fork end portion and a second handle end portion;

a second fork portion formed at an acute angle to the second elongated bar portion at the second fork end portion;

a connector portion connecting the first elongated bar portion and the second elongated bar portion at the first fork end portion and the second fork end portion;

at least one intermediate connector portion connecting the first elongated bar portion and the second elongated bar portion at at least one location between the first and second fork end portions and the first and second handle end portions;

wherein the first elongated bar portion and the second elongated bar portion are spaced apart at a predetermined distance.

2. The demolition tool of claim 1, further comprising a first curved transition portion connecting the first elongated bar portion and first fork portion.

3. The demolition tool of claim 2, further comprising a second curved transition portion connecting the second elongated bar portion and second fork portion.

4. The demolition tool of claim 1, wherein the first fork portion has a first beveled end and the second fork portion has a second beveled end.

5. The demolition tool of claim 1, wherein the first elongated bar portion and first fork portion lie in a first plane, and wherein the second elongated bar portion and second fork portion lie in a second plane, and wherein the first plane is parallel to the second plane.

6. The demolition tool of claim 1, wherein the predetermined distance is in the range of 2 inches to 6 inches.

7. The demolition tool of claim 6, wherein the range is 3 inches to 4 inches.

8. The demolition tool of claim 7, wherein the predetermined distance is 3 inches.

9. The demolition tool of claim 1, wherein the at least one intermediate connector portion comprises a plate and the connector portion comprises a cross bar.

10. The demolition tool of claim 1, wherein the first and second fork portions define a height, and the demolition tool forms an overall linear length, and wherein the ratio of the height of the fork portions and the overall linear length of the demolition tool is in the range of 1:6 and 5:16.

11. The demolition tool of claim 10, wherein the ratio of the height of the fork portions and the overall linear length of the demolition tool is 4:17.

12. The demolition tool of claim 11, wherein the height of the fork portions is 8 inches and the overall linear length of the demolition tool is 34 inches.

13. The demolition tool of claim 1, wherein the linear length of the first and second handle end portions is 9 inches.

14. The demolition tool of claim 2, wherein an inner radius of the first curved transition portion is 0.452 inches, and an outer radius of the first curved transition portion is 1.327 inches.

15. The demolition tool of claim 3, wherein an inner radius of the second curved transition portion is 0.452 inches, and an outer radius of the second curved transition portion is 1.327 inches.

16. The demolition tool of claim 1, further comprising handle grips attached to the first and second handle end portions.

17. The demolition tool of claim 1, wherein the demolition tool is of an aluminum alloy material.

18. A method of using a demolition tool comprising the steps of:

affixing a first elongated bar portion having a first fork end portion and a first handle end portion to a second elongated bar portion having a second fork end portion and a second handle end portion;

forming a first fork portion at an acute angle to the first elongated bar portion at the first fork end portion;

forming a second fork portion at an acute angle to the second elongated bar portion at the second fork end portion;

connecting the first elongated bar portion and the second elongated bar portion at the first fork end portion and the second fork end portion via a connector portion;

connecting the first elongated bar portion and the second elongated bar portion at at least one location between the first and second fork end portions and the first and second handle end portions via at least one intermediate connector portion;

spacing apart at a predetermined distance the first elongated bar portion and the second elongated bar portion;

positioning the first and second fork portions, one on each side of a structure, and extending behind an object attached to the structure;

grasping the first handle end portion with one hand, and grasping the second handle end portion with another hand;

applying a force to the grasped handle end portions; and leveraging the first and second fork portions to separate the object from the structure.

19. The method of claim 18, further comprising the step of:

using a cross bar between the two fork portions as a fulcrum.

20. The method of claim 18, further comprising the step of:

placing a hand grip on each of the two handle end portions of the demolition tool.

* * * * *